United States Patent [19]

Takahashi

[11] Patent Number: 4,782,807

[45] Date of Patent: Nov. 8, 1988

[54] UNIT INJECTOR FOR AN INTERNAL COMBUSTION ENGINE

[75] Inventor: Takeshi Takahashi, Mishima, Japan

[73] Assignee: Toyota Jidosha Kabushiki Kaisha, Aichi, Japan

[21] Appl. No.: 84,557

[22] Filed: Aug. 12, 1987

[30] Foreign Application Priority Data

Sep. 5, 1986 [JP] Japan ..... 61-210126

[51] Int. Cl.[4] ..... F02M 39/00

[52] U.S. Cl. ..... 123/506; 123/498

[58] Field of Search ..... 123/506, 498, 458, 495, 123/497

[56] References Cited

U.S. PATENT DOCUMENTS 3,465,732 9/1969 Kattchfe ..... 123/498
3,589,345 6/1971 Benson ..... 123/498
4,622,942 11/1986 Nozaki ..... 123/498
4,643,155 2/1987 O'Neill ..... 123/506
4,697,565 10/1987 Kobayashi ..... 123/506

FOREIGN PATENT DOCUMENTS 57-28863 2/1982 Japan .
61-187965 11/1986 Japan .

*Primary Examiner*—Carl Stuart Miller
*Attorney, Agent, or Firm*—Kenyon & Kenyon

[57] ABSTRACT

A unit injector for an internal combustion engine comprising a spill valve provided between a pressurizer unit and a nozzle unit. The spill valve, driven through a hydraulic amplification link by a piezoelectric actuator, slides in a cylindrical passage that transversely intersects a fuel supply path between the pressurizer unit and the nozzle unit to open and shut a spill port opening from the cylindrical passage into a return path. Fuel injection quantity is determined by opening the spill valve at a preselected point in the injection stroke of a reciprocating plunger in the pressurizer unit.

10 Claims, 2 Drawing Sheets

UNIT INJECTOR FOR AN INTERNAL COMBUSTION ENGINE

CROSS REFERENCE TO RELATED APPLICATION

This application is owned in common with copending U.S. application Ser. No. 07/073,155 filed on July 14, 1987 for PIEZOELECTRIC ACTUATOR.

BACKGROUND OF THE INVENTION

1. Field of the Invention

This invention relates to a unit injector for an internal combustion engine, especially to a unit injector for a diesel engine.

2. Prior Art

As a fuel injection system for a diesel engine, a unit injector integrally composed of a pressurizer unit, functioning as a fuel injection pump, and a fuel injection nozzle unit is well-known. For example, Japan Published Unexamined patent application sho No. 57-28863 discloses a unit injector in which a spill port having a spill valve is formed in a conduit between a pressurized unit and a fuel injection nozzle unit, the spill port communicating with a return path.

The spill valve is driven by oil pressure developed in a pressure source to selectively open and shut the spill port for respectively connecting and disconnecting the conduit and the return path. This oil pressure to the spill valve is controlled by either a mechanical rotary slide valve or a solenoid valve. When the spill valve is closed, fuel is supplied from the pressurizer unit to the fuel injection nozzle unit. When the spill valve is opened, fuel from the pressurizer unit is bypassed through the spill port to the return path.

The above-mentioned prior art unit has a problem in that both the mechanical rotary slide valve and the solenoid valve have relatively slow responses, leading to inaccurate fuel injection. For improved responsiveness, an actuator having a piezoelectric element may be used to drive the spill valve. However, the change in length (i.e., effective stroke) obtainable from a piezoelectric element is element only about a thousandth of the total length of the element, so a large-sized actuator having a large element is required to obtain a desired length change. Such a large unit is difficult to install as an integrall part of a unit injector.

SUMMARY OF THE INVENTION

Accordingly, an object of the invention is to provide a unit injector of high responsiveness making use of a piezoelectric actuator.

Another object of the present invention is to provide a unit injector in which a piezoelectric actuator is as small as possible.

For accomplishing these and other objects, a unit injector according to the present invention includes a pressurizer unit for pressurizing fuel, a nozzle unit for injecting the pressurized fuel, and a spill unit provided between the pressurizer unit and the nozzle unit for bypassing the fuel. The spill unit includes a cylindrical passage serving as a spill port communicating a fuel supply path between the pressurizer unit and the nozzle unit with a fuel return path. The axis of the cylindrical passage transversely intersects the fuel supply path, and a spill valve is slidably inserted in the cylindrical passage for controlling the communication of the fuel supply path with the fuel return path. The spill unit further includes a piezoelectric actuator for moving the spill valve. The actuator comprises: a piezoelectric element having a dimensional change axis parallel to the direction of movement of the spill valve; a rod, mechanically coupled to the spill valve directly or indirectly, with a cross section smaller than a cross section of the piezoelectric element; and a cylinder filled with an incompressible fluid and hydraulically coupling the piezoelectric element to one end of the rod, so that a dimensional change of the piezoelectric element is transformed into a movement of the rod.

The piezoelectric actuator is defined by an actuator having a piezoelectric element, which provides a dimensional change and a substantial force when voltage is applied. For the piezoelectric element, for example, piezoelectric ceramics consisting of laminated PZT (Pb zirconate titanate), polymer piezoelectric materials and crystal are available.

Various types of fluid may be enclosed within the cylinder of the spill unit so long as the fluid is essentially incompressible under pressure. Liquid is a suitable example.

In a unit injector having the above-mentioned construction, the piezoelectric element is expanded and contracted by applying and stopping voltage. The dimensional change of the piezoelectric element is transmitted to the rod through the cylinder. Since the diameter of the rod is smaller than that of the piezoelectric element, the expansion and contraction of the element is amplified at the rod, and thus at the spill valve. Preferably, the piezoelectric element expands and contracts in the same direction as the spill valve slides so that the actuator can be closely coupled to the spill valve. Thus it is possible to open and close the spill valve using a relatively smallsized actuator.

BRIEF DESCRIPTION OF DRAWINGS

The foregoing and other objects and features of the invention will be apparent from the following description taken in connection with the accompanying drawings, in which.

DETAILED DESCRIPTION OF THE PREFERRED EMBODIMENT

Figure 1:
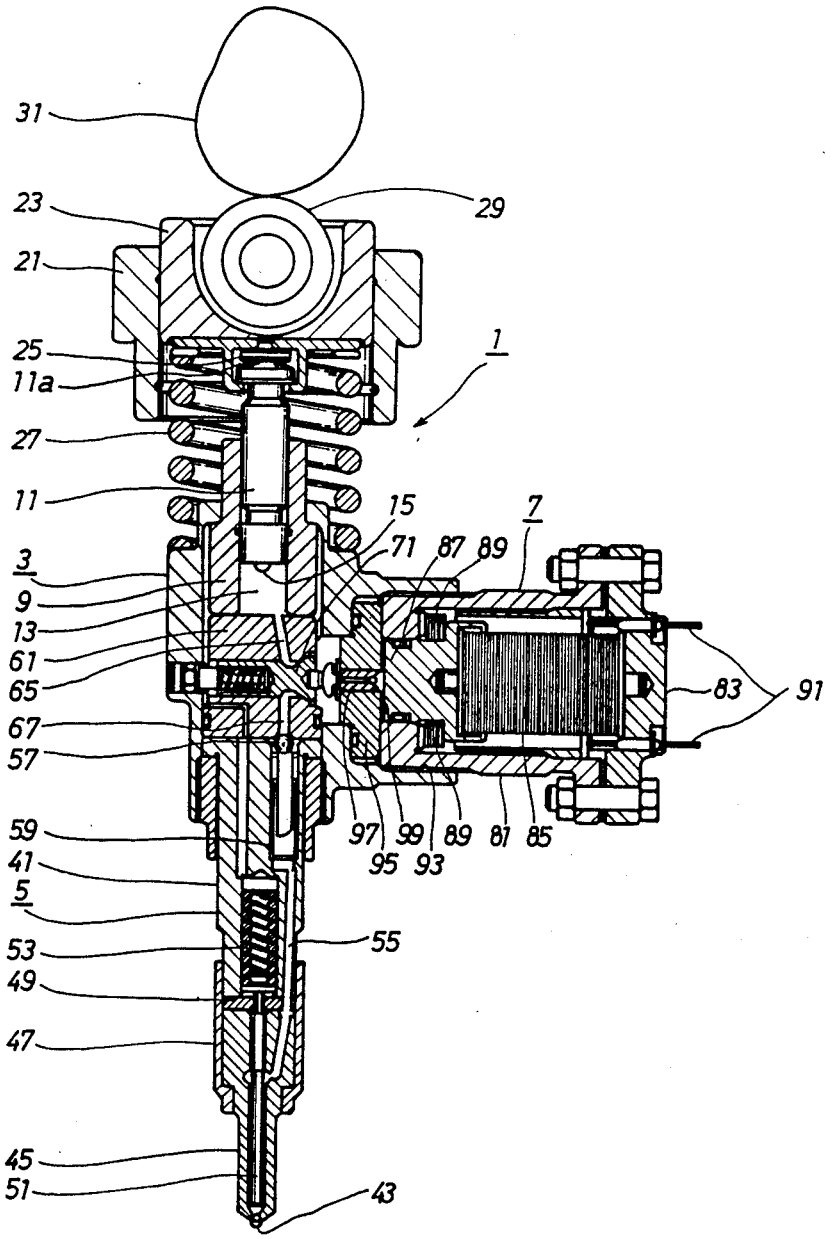
FIG. 1 shows a sectional view of a unit injector accorting to an embodiment of the present invention.

As shown in FIG. 1, a unit injector 1 consists of a pressurizer unit 3, a nozzle unit 5 fixed to the bottom of the pressurizer unit 3, and a piezoelectric actuator 7 attached to the side of the pressurizer unit 3.

A plunger barrel 9, in which a plunger 11 is slidably inserted, is fixedly inserted in the pressurizer unit 3. The plunger barrel 9 and the plunger 11 form a pressure changer 13. The plunger barrel 9 is provided with a port 15 (only lower half of the port 15 appears in FIG. 1) by which fuel supplied from a fuel source (not shown) flows into the pressure chamber 13.

A top 11*a* of the plunger 11 is coupled to a tappet 23 via a tappet shim 25. The tappet 23 is slidably mounted in a tappet holder 21 which is independent of the pressurizer unit 3. The tappet 23 is biased upward by a tappet spring 27. The tappet 23 has a roller 29 which cooperates with a cam 31 above the roller 29 for moving the tappet 23 vertically, thereby reciprocating the plunger for generating pressure in the pressure chamber 13. The top 11*a* of the plunger 11 is shaped spherically, so that the pressure force is always applied from the tappet 23 along the axis of the plunger 11.

The nozzle unit 5 includes a fitting base 41, a nozzle 45 having a fuel injection port 43, and a nozzle holder 47 which couples the fitting base 41 and the nozzle 45 via a nozzle spacer 49. A needle 51, which is slidably inserted in the nozzle 45, opens and shuts the injection port 43. A needle spring 53, which is provided in the fitting base 41, thrusts the needle 51 toward the injection port 43. A nozzle fuel path 55 for supplying fuel to the injection port 43 has a nozzle check ball 57 at its end near the pressure chamber 13. A bar filter 59 for restricting displacement of the nozzle check ball 57 and for eliminating impurities from the fuel is provided under the nozzle check ball 57.

Figure 2:
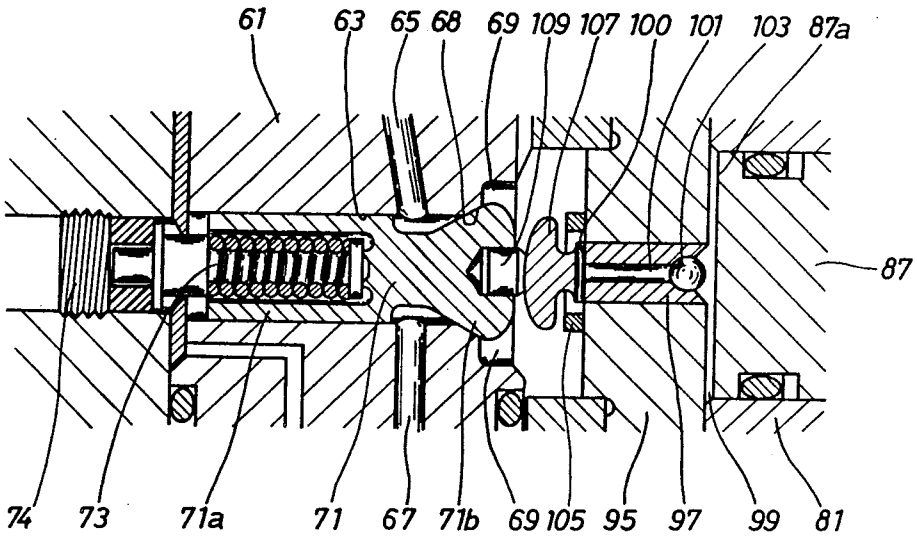
FIG. 2 shows a partial enlarged sectional view of the unit injector.

A spill unit comprising an intermediate member 61 is provided between the pressurizer unit 3 and the nozzle unit 5. As shown in FIG. 2, the intermediate member 61 has a cylindrical spill passage 63 which communicates with the pressure chamber 13 through a first fuel path 65, and with the nozzle fuel path 55 through a second fuel path 67. The spill passage further communicates with a return path (not shown) through a spill port 68 and an opening 69. A spill valve 71, which is slidably inserted in the spill passage 63, is pushed rightward by a spill valve spring 73 provided in a guide part 71*a* of the valve 71. The force of valve spring 73 is adjusted by a machine screw 74. When the spill valve 71 moves leftward, a valve head 71*b* disconnects the spill port 63 from the opening 69. When the spill valve 71 moves rightward, the cylindrical passage 63 is connected with the opening 69.

As shown in FIG. 1, an actuator housing 81 and an outer cover 83 enclose the piezoelectric actuator 7. In the actuator housing 81, an actuator element 85 is fixed by coupling one of its ends to the outer cover 83 and the other end to an actuator piston 87. The actuator piston 87 is biased to the right by belleville springs 89. The outer cover 83 receives two electrodes 91 by which a driving circuit (not shown) applies voltage to the piezoelectric element 85. The piezoelectric actuator 7 is screwed in a bore 93 provided on the side surface of the pressurizer unit 3, via an actuator spacer 95, so that the piezoelectric element 85 expands and contracts in the same direction as the spill valve 71 slides.

As shown in FIG. 2, an actuated piston or rod 97 having a diameter smaller than that of the actuator piston 87, is slidably inserted in the actuator spacer 95. A cylinder 99 is formed by the right end of the spacer 95, the right end of the rod 97, the left end 87*a* of the piston 87, and the inner wall of the housing 81. The cylinder 99 is filled with fuel from the injector 1. Here the fuel works as a hydraulic medium. A side fuel path 100 is provided across the rod 97 and a rod fuel path 101 is provided along the center axis of the rod 97. At one end of the path 101, facing the cylinder 99, a rod check ball 103 is provided. Fuel is supplied to the cylinder 99 through the side path 100 and the path 101, and the rod check ball 103 prevents a countercurrent of fuel from the cylinder 99. The left end of the rod 97 forms a mushroom shaped head portion 107 and works as a push member for the spill valve 71. A rod shim 105 is attached on the left wall of the spacer 95 to restrict the rightward displacement of the rod 97. The left end of the head portion 107 abuts on the spill valve 71 via a push member shim 109.

Operation

FIG. 1 shows the unit injector 1 in the condition where the plunger 11 is about half way through its upward travel, and the piezoelectric element 85 is energized. While the plunger 11 moves upward, fuel flows into the pressure chamber 13 via the through hole 15. When the piezoelectric element 85 is energized, it extends to move the actuator piston 87 leftward. Thus, the capacity of the cylinder 99 is decreased causing oil pressure to push the rod 97 to the left. The linear displacement of the actuator piston 87 produces linear displacement of the rod 97 that is amplified by the ratio of the area of the actuator piston to the area of the rod. The displacement of the rod 97 drives the spill valve 71 leftward, via the head portion 107 and the push member shim 109, thereby shutting the spill port 68. When the plunger 11 starts to descend in accordance with the rotation of the cam 31, the pressure in the chamber 13 increases. As a result, the needle 51 is pushed up thereby opening the injection port 43 through which fuel is injected.

When fuel injection is to be stopped, the piezoelectric element 85 is deenergized. The piezoelectric element 85 immediately contracts, and the actuator piston 87 is moved rightward by the belleville springs 89. Consequently, the spill valve 71 is moved to the right by the spill valve spring 73, thereby connecting the spill port 68 with the opening 69. Fuel from the pressure chamber 13 is spilled via the opening 69 to the return path. As a result, even though the plunger 11 continues to descend, the pressure in the chamber 13 is relieved so that the needle 51 closes the injection port 43, thereby stopping fuel injection. Fuel injection quantity is controlled in this way.

As described above in detail, in the unit injector 1 according to the present embodiment, the piezoelectric actuator 7 is used for actuating the spill valve 71. Since the piezoelectric element 85 of the actuator 7 has quick response, it is possible to precisely control the fuel injection time and quantity by the electrical operation of the piezoelectric element. Also, it is possible to effect a so-called pilot injection, which has been difficult for the prior unit injectors.

Since the diameter of the rod 97 is smaller than that of the actuator piston 87, the linear expansion and contraction of the actuator 7 is amplified at the spill valve 71. Therefore, it is possible to miniaturize the actuator 7 for obtaining a desired displacement of the spill valve 71.

The present embodiment has additional advantages as follows. In the unit injector 1, the actuator 7 and the valve 71 are coupled through the rod 97 and the cylinder 99. The rod fuel path 101, by which fuel passing the side path 100 is supplied to the cylinder 99, extends along the center axis of the rod 97 and has the rod check ball 103 on the end exposed to the cylinder 99. Therefore, even when fuel leaks out of the cylinder 99, or bubbles get mixed in the fuel in the cylinder 99, it is possible to replenish the fuel in the cylinder 99 in order to keep the cylinder 99 completely full of incompressible fluid. Further, it is possible to prevent fuel in the cylinder 99 from returning to the fuel path 101. Thus, stable fuel injection can be maintained from operation start without defective movement of the rod 97 caused by the bubbles mixed in the fuel.

The bar filter 59, which is provided in an optional position in the nozzle fuel path 55 between the pressurizer unit 3 and the injection port 43, is in contact with the nozzle check ball 57 in the path 55. Therefore, the bar filter 59 not only eliminates impurities from fuel but also restricts the displacement of the nozzle check ball 57 according to the position of the bar filter 59.

As described before, the top 11*a* of the plunger 11, abutting on the tappet shim 25, has a spherical shape. Therefore, even if the tappet 23 moves down slantwise within a gap between the tappet 23 and the tappet holder 21 when the vehicle is slanted by a side force, the pushing force is always applied axially to the plunger 11, thus preventing the plunger 11 from partial wear.

Fuel supplied from the pressure chamber 13 applies pressure to equal areas of the guide portion 71*a* and the valve head 71*b;* that is, the spill valve 71 is an equalizer valve. Consequently, there is no net axial fuel pressure force acting on the valve, as would occur if the two pressurized areas were different. The piezoelectric actuator 7 has only to overcome the biasing force of the spill valve spring 73. Therefore, it is possible to miniaturize still further the piezoelectric actuator.

Since the spill valve 71 slides in the cylindrical passage 63 transversely to the axis of the unit injector 1, the volume of the fuel path between the pressurizer unit 3 and the nozzle unit 5 is minimized, thereby improving fuel injection characteristics.

While a preferred embodiment has been described, variations thereto will occur to those skilled in the art within the scope of the present inventive concepts which are delineated by the following claims.

What is claimed is:

1. A unit injector for an internal combustion engine, the injector comprising:

a pressurizer unit for pressurizing fuel;

a nozzle unit for injecting the pressurized fuel; and a spill unit disposed between the pressurizer unit and the nozzle unit, the spill unit including a fuel supply path connecting the pressurizer unit to the nozzle unit, a cylindrical passage having a center axis transversely intersecting the fuel supply path and forming at one end a spill port opening into a fuel return path, a spill valve movable in the cylindrical passage between an open position for permitting communication between the fuel supply path and the fuel return path through the spill port and a shut position for preventing communication through the spill port, and actuating means for moving the spill valve between the open position and the shut position, wherein the actuating means comprises:

a piezoelectric element having a dimensional change axis and an actuating end transverse to said axis, said actuating end being movable parallel to the actuating axis in response to energization and deenergization of the piezoelectric element;

an actuator piston mechanically coupled to the actuating end of the piezoelectric element for movement therewith, the actuating piston having a first end with a first cross-sectional area;

an actuated piston mechanically coupled to the spill valve, the actuated piston having a first end with a second cross-sectional area substantially smaller than the first cross-sectional area of the actuator piston; and means for hydraulically coupling the first end of the actuator piston and the first end of the actuated piston such that a linear displacement of the actuator piston produces a linear displacement of the actuated piston amplified by the ratio of the first cross-sectional area to the second crosssectional area.

2. A unit injector for an internal combustion engine, the injector comprising:

a pressurizer unit for pressurizing fuel;

a nozzle unit for injecting the pressurized fuel; and a spill unit disposed between the pressurizer unit and the nozzle unit, the spill unit including a fuel supply path connecting the pressurizer unit to the nozzle unit, a cylindrical passage having a center axis transversely intersecting the fuel supply path and forming at one end a spill port opening into a fuel return path, a spill valve movable in the cylindrial passage between an open position for permitting communication between the fuel supply path and the fuel return path through the spill port and a shut position for preventing communication through the spill port, and actuating means for moving the spill valve between the open position and the shut position wherein the actuating means comprises:

a piezoelectric element having a dimensional change axis and an actuating end transverse to said axis, said actuating end being movable parallel to the actuating axis in response to energization and deenergization of the piezoelectric element;

an acutator piston mechanically coupled to the actuating end of the piezoelectric element for movement therewith, the actuating piston having a first end with a first cross-sectional area;

an actuated piston mechanically coupled to the spill valve, the actuated piston having a first end with a second cross-sectional area substantially smaller than the first cross-sectional area of the actuator piston; and means for hydraulically coupling the first end of the actuator piston and the first end of the actuated piston such that a linear displacement of the actuator piston produces a linear displacement of the actuator piston amplified by the ratio of the first cross-sectional area to the second cross-sectional area, wherein the means for hydraulically coupling the actuator piston and the actuated piston comprises a rigid cylinder having a first bore slidingly receiving the actuator piston and a second bore slidingly receiving the actuated piston, the cylinder being completely filled with an incompressible fluid that contacts the first ends of the actuator piston and the actuated piston.

3. A unit injector according to claim 1 wherein the dimensional change axis of the piezoelectric element is parallel to the center axis of the cylindrical passage.

4. A unit injector according to claim 3 wherein the dimensional change axis of the piezoelectric element is coaxial with the center axis of the cylindrical passage.

5. A unit injector according to claim 2 wherein the incompressible fluid in the cylinder of the actuating means is liquid fuel, the actuated piston is formed with a through passage communicating the cylinder with the return path, and the actuated piston comprises a check valve for shutting said through passage when the pressure in the cylinder exceeds the pressure in the return path and for opening said through passage to permit replenishment of the liquid fuel in said cylinder when the pressure in the cylinder is less than the pressure in the return path.

6. A unit injector for an internal combustion engine, the injector comprising:

a pressurizer unit for pressurizing fuel;

a nozzle unit for injecting the pressurized fuel; and a spill unit disposed between the pressurizer unit and the nozzle unit, the spill unit including a fuel supply path connecting the pressurizer unit to the nozzle unit, a cylindrical passage having a center axis transversely intersecting the fuel supply path and forming at one end a spill port opening into a fuel return path, a spill valve movable in the cylindrical passage between an open position for permitting communication between the fuel supply path and the fuel return path through the spill port and a shut position for preventing communication through the spill port, and actuating means for moving the spill valve between the open position and the shut position, wherein the actuating means comprises:

a piezoelectric element have a dimensional change axis and an actuating end transverse to said axis, said actuating end being movable parallel to the actuating axis in response to energization and deenergization of the piezoelectric element;

an actuator piston mechanically coupled to the actuating end of the piezoelectric element for movement therewith, the actuating piston having a first end with a first cross-sectional area;

an actuated piston mechanically coupled to the spill valve, the actuated piston having a first end with a second cross-sectional area substantially smaller than the first cross-sectional area of the actuator piston; and means for hydraulically coupling the first end of the actuator piston and the first end of the actuated piston such that a linear displacement of the actuator piston produces a linear displacement of the actuated piston amplified by the ratio of the first cross-sectional area to the second crosssectional area wherein the spil valve comprises a valve stem slidably fitted in the cylindrical passage and traversing the fuel path, a valve head formed on the valve stem and having a seating surface disposed on the fuel return path side of the spill port for making sealing contact with the spill port when the valve is in the shut position, the valve stem having a peripheral recess extending from the fuel supply path to the seating surface on the valve head and an area exposed to fuel supply pressure on the fuel supply path side of said peripheral recess equal to an area of the head portion exposed to fuel supply pressure when the valve is shut so that the valve is hydrostatically balanced when in the shut condition, and a spring for biasing the spill valve toward the open position.

7. An unit injector for an internal combustion engin, the injector comprising:

a pressurizer unit for pressurizing fuel;

a nozzle unit for injecting the pressurized fuel; and a spill unit disposed between the pressurizer unit and the nozzle unit, the spill unit including a fuel supply path connecting the pressurizer unit to the nozzle unit.

a cylindrical passage having a center axis transversely intersecting the fuel supply path and forming at one end a spill port opening into a fuel return path, a spill valve movable in the cylindrical passage between an open position for permitting communication between the fuel supply path and the fuel return path through the spill port and a shut position for preventing communication through the spill port, and actuating means for moving the spill valve between the open position and the shut position, wherein the actuating means comprises:

a piezoelectric element having a dimensional change axis and an actuating end transverse to said axis, said actuating end being movable parallel to the actuating axis in response to energization and deenergization of the piezoelectric element;

an actuator piston mechanically coupled to the actuating end of the piezoelectric element for movement therewith, the actuating piston having a first end with a first cross-sectional area;

an actuated piston mechanically coupled to the spill valve, the actuated piston having a first end with a second cross-sectional area substantially smaller than the first cross-sectional area of the actuator piston; and means for hydraulically coupling the first end of the actuator piston and the first end of the actuated piston such that a linear displacement of the acturated piston produces a linear displacement of the actuated piston amplified by the ratio of the first cross-sectional area to the second crosssectional area, wherein the pressurizer unit comprises:

a cylindrial body having a central bore communicating with the fuel supply path in the spill unit and a fuel delivery passage opening into the bore for delivering liquid fuel to the injector from a fuel source, the portion of the bore between the opening of the fuel delivery passage and the fuel supply path in the spill unit constituting a pressure chamber;

a plunger slidably fitted in the bore, the plunger having a first end facing the pressure chanber and a second end extending from the cylindrical body;

means for reciprocating the plunger in the bore between a first position of the first end which exposes the opening into the bore of the fuel delivery passage to the pressure chamber and a seocnd position inside the pressure chamber for delivering a predetermined amount of fuel to the fuel supply path.

8. A unit injector according to claim 7 wherein the second end of the plunger has a spherical surface, and the means for reciprocating the plunger comprises, in abutting sequence, a rotatable cam, a roller, a tapet which retains the roller, a shim which contacts the spherical surface of the plunger, and a spring which biases the plunger toward said first position.

9. A unit injector according to claim 7 wherein the nozzle unit comprises a nozzle unit body having an injection fip, a fuel passage leading from the fuel supply passage of the spill unit to the injection tip, and a spring-biased needle slidably inserted in the nozzle unit body for normally blocking the fuel passage at the injection tip, the needle being displaceable to oen the fuel passage in response to the delivery of fuel under pressure from the pressurizer unit while the spill valve is shut.

10. A unit injector according to claim 9 wherein the fuel passage includes a ball check valve and a bar filter adjacent to the check valve, the bar filter also serving as a retainer for the check ball.

* * * * *

UNITED STATES PATENT AND TRADEMARK OFFICE

CERTIFICATE OF CORRECTION

PATENT NO. : 4,782,807

DATED : November 8, 1988

INVENTOR(S) : Takeshi Takahashi

It is certified that error appears in the above-identified patent and that said Letters Patent is hereby corrected as shown below:

| Column | Line | |
|---|---|---|
| 1 | 21 | change "sho No." to --No. sho--. |
| 1 | 43 | after "is" delete "element". |
| 1 | 47 | change "integrall" to --integral--. |
| 2 | 35 | change "smallsized" to --small-sized--. |
| 2 | 44 | change "corting" to --cording--. |
| 6 | 2 | change "crosssec-" to -- cross-sec- -- |
| 6 | 16 | change "cylindrial" to --cylindrical--. |
| 6 | 44 | change "actuator" to --actuated--. |
| 7 | 24 | change "have" to --having--. |
| 7 | 45 | change "spil" to --spill--. |
| 7 | 61 | change "engin," to --engine,--. |
| 8 | 32 | change "acturated" to --actuator--. |
| 8 | 34-5 | change "cros-ssectional" to --cross-sectional--. |
| 8 | 46 | change "chanber" to --chamber--. |
| 8 | 53 | change "seocnd" to --second--. |

UNITED STATES PATENT AND TRADEMARK OFFICE

CERTIFICATE OF CORRECTION

PATENT NO. : 4,782,807

DATED : November 8, 1988

INVENTOR(S) : Takeshi Takahashi

It is certified that error appears in the above-identified patent and that said Letters Patent is hereby corrected as shown below:

| Column | Line | |
|---|---|---|
| 8 | 59 | change "tapet" to --tappet--. |
| 8 | 65 | change "fip" to --tip--. |
| 9 | 1 | change "oen" to --open--. |

Signed and Sealed this

Eighteenth Day of April, 1989

*Attest:*

DONALD J. QUIGG

*Attesting Officer*

*Commissioner of Patents and Trademarks*